US006457482B1

(12) United States Patent
Cooper

(10) Patent No.: US 6,457,482 B1
(45) Date of Patent: Oct. 1, 2002

(54) PORTABLE POWER-CLEANING DEVICE FOR USE WITH COMMONLY AVAILABLE CONTAINERS

(76) Inventor: John Clifford Cooper, 2641 Shadow Hill La., Plano, TX (US) 75093-6189

( * ) Notice: Subject to any disclaimer, the term of this patent is extended or adjusted under 35 U.S.C. 154(b) by 69 days.

(21) Appl. No.: 09/691,744

(22) Filed: Oct. 18, 2000

(51) Int. Cl.[7] ..... B08B 3/10
(52) U.S. Cl. ..... 134/117; 366/209
(58) Field of Search ..... 134/117, 118, 134/140, 150, 184, 185, 188; 15/94; 68/171, 172; 366/110, 128, 130, 209, 211, 605

(56) References Cited

U.S. PATENT DOCUMENTS 3,030,082 A * 4/1962 Matzen et al. ..... 366/209
3,735,962 A * 5/1973 Pagano ..... 366/605 X
4,318,622 A * 3/1982 Sterrenberg ..... 366/128 X
5,273,357 A * 12/1993 Currie ..... 366/110
5,947,594 A * 9/1999 Dolatli et al. ..... 366/209 X

* cited by examiner

*Primary Examiner*—Philip Coe

(57) ABSTRACT

A portable power-cleaning device for use with commonly available containers includes a pulsation device consisting of an electric motor with a shaft, an eccentric weight attached to the motor shaft, a speed control for the motor, and a mount that connects the motor to an adjustable bracket. A clamp or strap attaches the adjustable bracket to a container, and a cover protects the user from contact with the motor, electronic controls, and the eccentric weight.

4 Claims, 2 Drawing Sheets

PORTABLE POWER-CLEANING DEVICE FOR USE WITH COMMONLY AVAILABLE CONTAINERS

BACKGROUND OF THE INVENTION

This invention relates generally to the field of cleaning devices, and more particularly to a machine for creating a portable power-cleaning device that uses a commonly available container.

SUMMARY OF THE INVENTION

The primary object of the invention is to provide a simple, inexpensive and effective way of creating a portable, low-energy, power-cleaning machine.

Another object of the invention is to provide a device that can be easily attached to most commonly available water-tight containers for cleaning items placed in the container.

Yet another object of the invention is to provide a method for controlling the direction of the pulsation energy transmitted to the container by the device.

Still yet another object of the invention is to provide a method for controlling the amount of the pulsation energy created by the device and transmitted to the container.

In accordance with a preferred embodiment of the invention, a portable power-cleaning device using a commonly available container comprises an electric motor with a shaft, an eccentric weight attached to the motor shaft, a speed control for the motor, a mount that connects the motor to an adjustable bracket, a mount that attaches the adjustable bracket to a container, and a cover protects the user from contact with the motor, electronic controls, and the eccentric weight.

Other objects and advantages of the present invention will become apparent from the following descriptions, taken in connection with the accompanying drawings, wherein, by way of illustration and example, an embodiment of the present invention is disclosed.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiments are provided herein. It is to be understood, however, that the present invention may be embodied in various forms.

Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
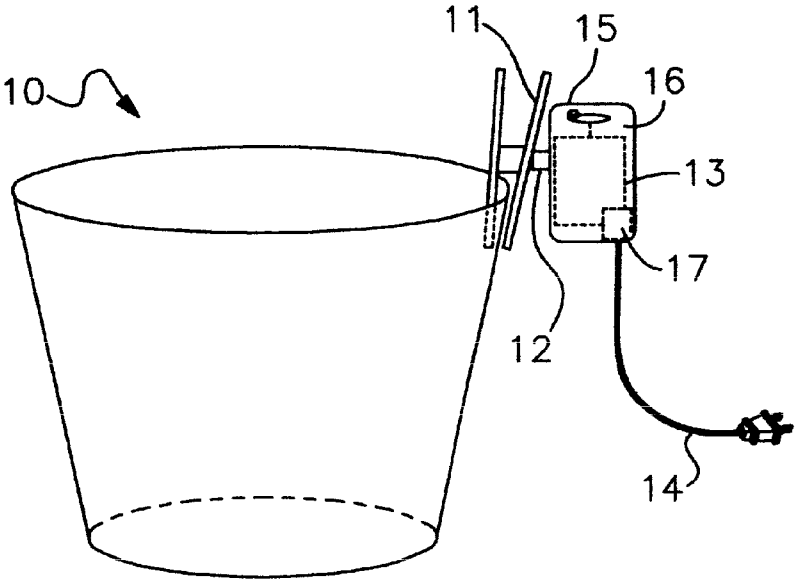
FIG. 1 is a perspective view of a preferred embodiment of the present invention.

Turning first to FIG. 1, there is shown a drawing of the inventions preferred embodiment. In the simplest form, the device includes motor 13 with eccentric weight 16 that can be attached to a commonly available container 10 by adjustable bracket 12 and clamp 11. Motor 13 and eccentric 16 are adjusted by pivoting the bracket 12, also shown in FIG. 3 as bracket 33 and FIG. 4 as bracket 43, to level the apparatus to the approximate horizontal plane of the container. In use a cleaning medium, either liquid or dry, is placed in container 10 with any items desired to be cleaned. Then, motor 13 and eccentric 16 is energized causing vibration, thereby causing vibration of container 10, thereby causing vibration of the cleaning medium in the container to move with wavelike pulsation. It is the pulsation energy transferred to the cleaning medium from motor 13 and eccentric 16 that causes the items placed in the container 10 to become clean. The items are scoured by the wavelike pulsation created by the machine.

In keeping with the principle objectives of the invention, it is easy to use and effective. No special knowledge, tools, or training are required to use the machine.

The device is energy efficient because the user can choose the best size container 10 for the specific task at hand. By matching the container size to the items or items to be cleaned, less cleaning medium need be used. For example, a one-gallon container may be used for cleaning glass objects whereas a five-gallon container may be more appropriate for automotive parts.

Figure 2:
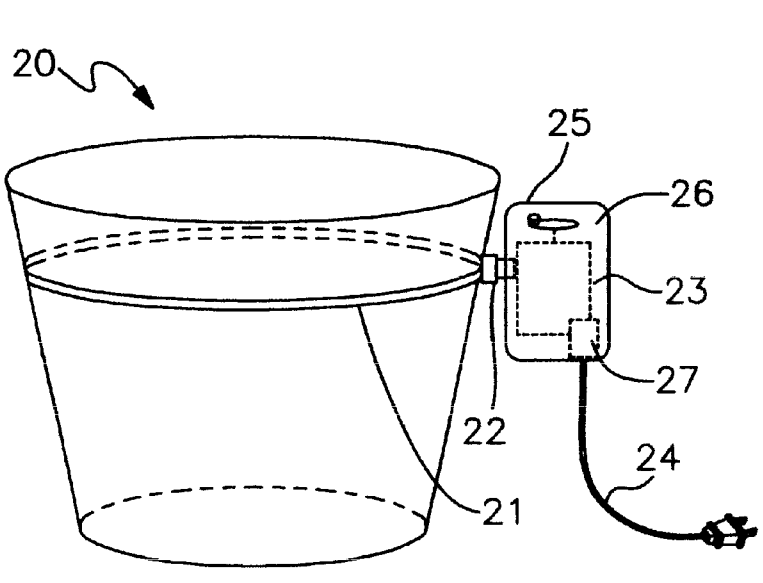
FIG. 2 is a perspective view of an alternate embodiment of the present invention.

Additional efficiency is recognized because the device uses very little electrical power in its preferred or alternate embodiments as shown in FIGS. 1 and 2. This is accomplished by the efficient creation of pulsation energy by the rotation of eccentric weight 16 or 26.

Figure 3:
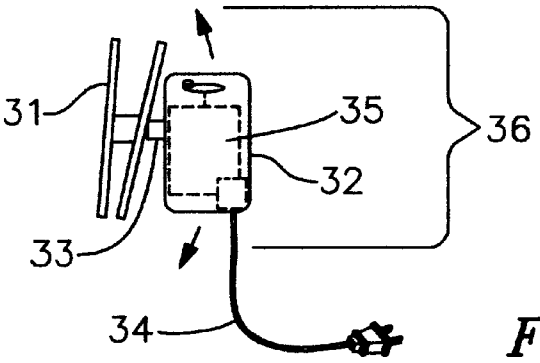
FIG. 3 is a side perspective view of the present invention in FIG. 1.
Figure 4:
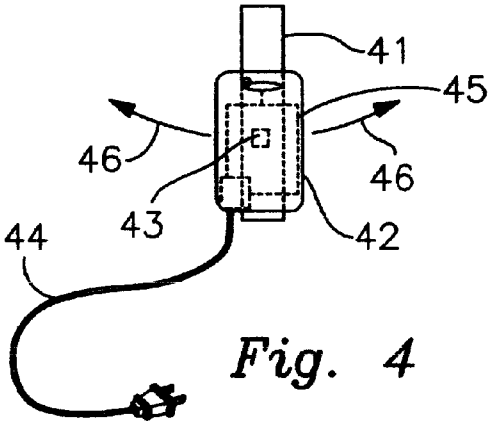
FIG. 4 is a front perspective view of the present invention in FIG. 1.

Efficiency is maximized by the easy adjustment of the eccentric plane to the horizontal of the cleaning medium by way of bracket 12, 22, 33 or 43, which has been found to create the most effective wave pulsation. Pivoting the device vertically as shown in FIG. 3 and horizontally as shown in FIG. 4 makes the adjustment. The device is then held in place by a locking or friction brake mechanism in the bracket itself. When the eccentric plane is parallel to the cleaning medium horizontal, maximum wave motion is created. It is the wave motion that is the cleaning force. Therefore, maximizing the force of the wave motion by adjusting the eccentric plane angle maximizes the resultant cleaning energy.

Future efficiency is recognized by adjusting the rotational speed of the motor 13 by an electronic control 17 to increase or decrease pulsation energy released from the eccentric 16. This balances the cleaning action to the magnitude of the job at hand. A safety cover 15 is used to protect the operator from the eccentric 16, motor 13, and electronic controls 17 while in use.

Another major advantage of the invention as shown in FIGS. 1 and 2 is that it works equally well with many different cleaning mediums and medium concentrations. For example, general dish detergent and water may be appropriate for one application (i.e.—glass cleaning), when a commercial degreaser may be best for another application (i.e.—automotive parts). Polishing may be accomplished by using common sand as the cleaning medium.

The pulsation device can be directly attached to a container specifically designed to house or receive the device. This would sacrifice some of the versatility of the invention for the sake of convenience by not having to supply a separate container.

Figure 5:
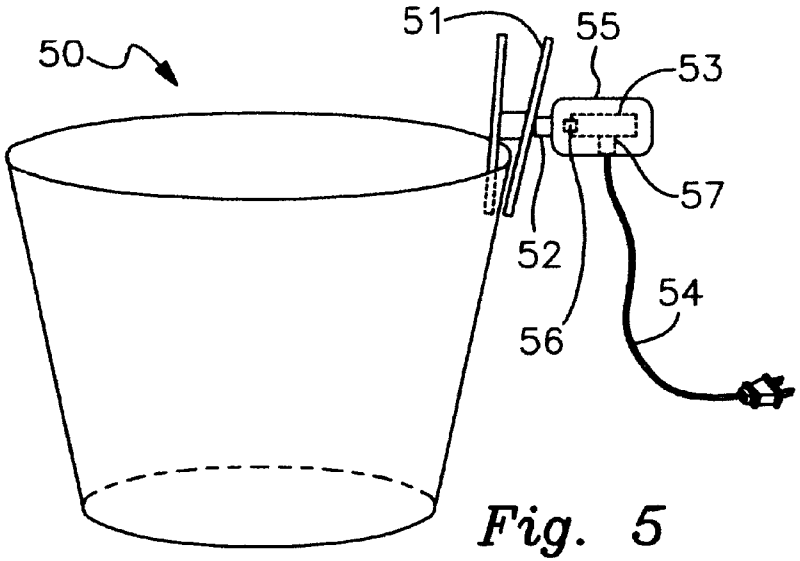
FIG. 5 is a perspective view of an alternate embodiment of the present invention.
Figure 6:
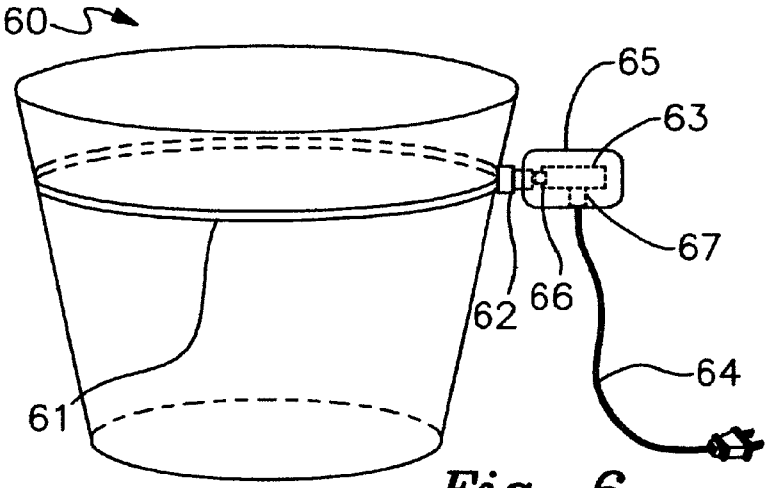
FIG. 6 is a perspective view of an alternate embodiment of the present invention.

Another alternative to the preferred embodiment is to use an electronic vibrator or solenoid device 53 or 63 such as shown in FIGS. 5 and 6 instead of the motor 13 and eccentric 16 combination to produce the pulsation force.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A portable power-cleaning device for use with commonly available containers comprising:

an electric motor with a shaft;

an eccentric weight attached to the motor shaft;

a speed control for the motor;

an adjustable bracket connected to the motor; and a mount that attaches the adjustable bracket to a container, whereby the motor may be adjusted by pivoting the bracket both horizontally and vertically to thereby adjust the eccentric plane defined by the motor, shaft, and eccentric weight to the horizontal which adjustment creates the most effective wave pulsation imparted to a cleaning medium in the container by means of the eccentricity defined by the motor, shaft, and eccentric weight as so attached to the container by means of the bracket and mount.

2. A portable power-cleaning device as claimed in claim 1 further comprising: a cover that protects the user from contact with the motor, speed control, and the eccentric weight.

3. A portable power-cleaning device as claimed in claim 1 wherein the mount that attaches the adjustable bracket to a container is an adjustable clamp.

4. A portable power-cleaning device as claimed in claim 1 wherein the mount that attaches the adjustable bracket to a container is an adjustable strap.

* * * * *